United States Patent [19]

Ginn

[11] 4,348,292

[45] Sep. 7, 1982

[54] MULTI-LAYERED LIQUID DETERGENT-BUILDER CONCENTRATE COMPOSITIONS WHICH ON ADDITION TO WATER PRODUCE STABLE CLEANING SOLUTIONS

[75] Inventor: Martin E. Ginn, Skokie, Ill.

[73] Assignee: Walton-March, Inc., Highland Park, Ill.

[21] Appl. No.: 197,918

[22] Filed: Oct. 17, 1980

[51] Int. Cl.[3] ..... C11D 17/04; C11D 11/00

[52] U.S. Cl. ..... 252/90; 252/135; 252/153; 252/174; 252/174.14; 252/174.21; 252/546; 252/547; 252/DIG. 14

[58] Field of Search ..... 252/90, 92, 153, 546, 252/135, 174.21, 547, DIG. 14, 174

[56] References Cited

U.S. PATENT DOCUMENTS

| | | | |
|---|---|---|---|
| 3,322,674 | 5/1967 | Friedman | 252/90 |
| 3,970,595 | 7/1976 | Ginn et al. | 252/545 |
| 4,122,043 | 10/1978 | Kersnar et al. | 252/527 |
| 4,234,442 | 11/1980 | Cornelissens | 252/90 |
| 4,239,639 | 12/1980 | Gilbert et al. | 252/90 |
| 4,253,842 | 3/1981 | Ehrlich | 8/137 |
| 4,264,479 | 4/1981 | Flanagan | 252/524 |

*Primary Examiner*—P. E. Willis, Jr.
*Attorney, Agent, or Firm*—Sidney Wallenstein

[57] ABSTRACT

A detergent system, especially adapted for single-use applications, in the form of a fluid-tight container having two separate layers of liquid compositions therein, one of the liquid compositions comprising a predetermined volume of a concentrate of a surfactant or detergent, and the other composition comprising a predetermined volume of a concentrate of an inorganic builder. The compositions are characterized in that, if mixed together in their concentrated form, they would be incompatible or immiscible, and would result in a non-homogeneous mixture. However, the compositions are so related as to the ingredients and proportions thereof, that when the separate layers are poured from the container into a predetermined volume of a diluent such as water, a stable cleaning or detergent solution or dispersion is obtained in ready-to-use form.

15 Claims, No Drawings

MULTI-LAYERED LIQUID DETERGENT-BUILDER CONCENTRATE COMPOSITIONS WHICH ON ADDITION TO WATER PRODUCE STABLE CLEANING SOLUTIONS

The present invention relates to detergent or cleaning concentrates especially adapted for single-use applications.

Generally speaking, in formulating liquid detergents and cleaners to provide an end product which is homogeneous in appearance, the ability to concentrate the ingredients comprising the formulation is limited by the degree of compatibility of the ingredients. Typically, conventional formulation approaches involve, for example, dissolving organic surfactants and inorganic builder components in aqueous media using coupling solvents and/or hydrotropes to attain a homogeneous and stable dispersion of the ingredients. This practice can give rise to problems because the organic surfactants tend to "salt out" of solution due to the presence of the alkaline inorganic salts employed in the builder. Thus, even when cosolubilizing agents are used, there is a critical upper limit as to the quantity of the functional components which can be maintained in dispersion in the end product. In a sense, there is what might be called a "compatibility barrier" in the conventional formulation of liquid detergents and cleaners. A formulator, therefore, has considerable difficulty in utilizing larger concentrations of the more active components. Wholly apart from the ingredient incompatibility and concentration of ingredient problems encountered with conventional formulating practices, such practices have important economic disadvantages, chief among which are the need for cosolubilizing agents, and the comparatively large volumes of water required to attain a homogeneous end product. In this latter connection, it should be noted that typical liquid detergent and cleaning formulations contain 50%, or more, water, while the active surfactant content is of the order of 16%, or less. Cosolubilizing agents such as coupling solvents and hydrotropes, of course, represent an added raw material cost, while the need for appreciable volumes of water adds to the material handling costs and at the same time entails the use of containers, or packaging, of a correspondingly larger size to accommodate the end product.

In accordance with the present invention, a system has been evolved for providing liquid detergents and cleaners in a highly concentrated form which eliminates the need for cosolubilizing agents and large volumes of water. The resulting significant savings in starting material and material handling costs are augmented by the fact that the system enables smaller and less costly containers, or packaging, to be used to hold the concentrates. What is more, the systems provide stable, ready-to-use solutions which not only are less costly on a unit volume basis than is the case with conventional homogeneous cleaning solutions, but, also, show surprisingly improved cleaning efficiency on a unit volume basis over homogeneous solutions.

The system of the present invention is especially adapted for single-use applications to provide a substantially homogeneous, dilute solution or dispersion of predetermined composition to be used for detergent, cleaning, or the like, purposes. The system comprises a fluid-tight container having at least two separate layers of liquid compositions therein, one of the layers comprising, as an essential ingredient, a predetermined quantity of a concentrate of at least one surfactant which is soluble or readily dispersible in a diluent such as water. Another of the layers in the container advantageously comprises, as an essential ingredient, a solution or dispersion, in the form of a concentrate, which incorporates a predetermined quantity of at least one detergent builder. The compositions of the separate layers in the container are of a character such that, if mixed together in their concentrated form, they would be incompatible or immiscible, and the resulting mixture would be non-homogeneous. The compositions of the separate layers, however, are so related as to the components, or ingredients, and proportions thereof that when essentially all of the liquid contents of the container are poured into a predetermined quantity of a diluent such as water, a final, essentially stable solution or dispersion is obtained in ready-to-use form. In marked contrast to typical homogeneous formulations, the active surfactant concentrate portion of the system, in most instances, will contain less than 10%, usually 4 or 5%, of water, and, in other cases, depending upon the nature of the ingredients employed, will contain no added water. The system can be formulated to provide, in ready-to-use form, stable solutions useful as hard surface cleaners, degreasers, bowl cleaners, floor wax removers, liquid dishwashing detergents, commercial or household heavy duty laundry liquids, concentrated liquid hand soaps, carpet shampoo concentrates, high strength metal cleaners, car wash concentrates, and the like.

In accordance with a preferred embodiment of the invention, the system comprises a water soluble surfactant concentrate layer component and a water soluble builder concentrate layer component packaged in a suitable, flexible or rigid plastic liquid-tight container. Generally speaking, the ingredients employed in formulating the surfactant concentrate layer will be dependent upon the use to which the finally produced stable, ready-to-use solution is to be put. Thus, for example, if the solution is to be used as a hard surface cleaner, the surfactant concentrate layer will advantageously comprise as an essential ingredient a major proportion of a water soluble nonionic surfactant or a compatible mixture of nonionic surfactants. On the other hand, if, for example, the ready-to-use solution is to be employed as a degreaser, the surfactant concentrate layer desirably will comprise a major proportion of a compatible mixture of water soluble nonionic, anionic, cationic or amphoteric surfactant materials or a mixture of nonionic and anionic surfactants.

Exemplary of water soluble nonionic surfactants useful for the purposes of this invention are polyglycol esters of higher straight and branched chain aliphatic alcohols and polyglycol esters of higher fatty acids, in which the alcohol group and the fatty acid group, respectively, comprises 8 to 20, or more, carbon atoms and which contain 10 to 50 ethylene oxide units per molecule. Especially preferred nonionic surfactants are the water soluble condensates of alkylphenols such as octyl- or nonylphenol with from about 5 to about 15 moles of ethylene oxide. Also useful are the numerous compounds obtained from the reaction of alkanolamines and fatty acids, and the ethylene oxide condensates thereof.

Water soluble anionic surfactants which can be used include alkyl aryl sulfonates, in particular alkylbenzene, especially linear monoalkyl benzene, sulfonates in which the alkyl group contains from 8 to 20 carbon atoms, specific examples being n-dodecylbenzene sulfonate and n-octadecylbenzene sulfonate; higher aliphatic sulfates and sulfonates in which the aliphatic radical comprises from 8 to 20 carbon atoms such as lauryl sulfate or lauryl sulfonate; and higher fatty acid amides in which the acyl group contains from 8 to 20 carbon atoms such as tallow fatty acid amide, cocoa fatty acid amide, and the like. The sulfates and sulfonates are commonly used in the form of alkali metal salts, although the corresponding salts of ammonium or organic bases such as ethanolamine, triethanolamine, and the like may also be used.

Cationic surfactants useful in formulating the surfactants concentrate layer of the system include quaternary ammonium salts represented by the formula:

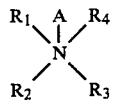

where: $R_1$ is hydrogen, alkyl or alkylol; $R_2$ and $R_3$ are lower alkyl or alkylol, or aryl or aralkyl; $R_4$ is a long chain alkyl radical containing from 8 to 22, preferably 12 to 15 carbon atoms in straight or branched chain arrangement, with or without aryl or alkaryl substituents; and A is an anion such as halogen, sulfate, acetate, hydroxyl, or the like. Specific examples of such salts are cetyl-dimethyl-benzyl-ammonium chloride, didodecyl-benzyl-methyl ammonium chloride and dodecyl-dimethylethylbenzyl ammonium chloride, to mention a few. Another group of quaternary substituted ammonium compounds which can be used are heterocyclic derivatives wherein N is an element in a heterocyclic ring. Typical of this group are lauryl morpholinium, imidazolium, pyridinium and quinolium compounds specific examples of which are N-benzyl-N higher alkyl morpholinium chloride and N-laurylmethyl pyridinium chloride.

Amphoteric surfactants which can be used to formulate the surfactant concentrate layer of the system include betaine and various betaine compounds such as coco betaine, tallow betaine, cocoyl amido propyl betaine, laurylamidipropyl betaine, to mention a few. Also useful as amphoterics are substituted imidazolines exemplified by mono- and dicarboxyl coco imidazoline, lauryl imidazoline, coco imidazoline, and the like.

The active surfactant ingredient, that is, the nonionic, anionic, cationic or amphoteric surfactant, or a compatible mixture thereof, employed in preparing the surfactant concentrate layer of the system comprises, as indicated hereinabove, a major proportion of the layer. The generally optimum objectives of the invention are attained with active surfactant concentrations of from about 50% to upwards of about 99%, by weight, of the surfactant concentrate layer. The finished surfactant concentrate layer desirably includes minor amounts of materials which will make the stable, ready-to-use solution prepared from the system of the present invention more effective and more attractive. The following are mentioned by way of example. A defoamer such as silicone and silicone emulsions, and fluorescers, perfumes and dyes. The concentration of such additives in the layer will range from about 0.01% to about 8 or 10%, by weight of the concentrate. Other additives, of course, can be used without departing from the spirit and scope of the invention.

The ingredients employed in formulating the water soluble builder concentrate layer of the system, for optimal results, will be dictated in large measure by the composition of the surfactant concentrate layer. As indicated hereinabove, the surfactant concentrate layer and the builder concentrate layer are of a character such that, if mixed together in their concentrated form, they would incompatible or essentially immiscible, and the resulting mixture would be non-homogeneous. However, the ingredients comprising each layer are so related with respect to their functional properties and their proportions in the layers that when both layers are poured into a predetermined volume of a diluent such as water, a final essentially stable detergent or cleaning solution, or dispersion, is produced in ready-to-use form.

By way of illustration, in formulating a builder concentrate layer for use with a surfactant concentrate layer intended for producing a stable detergent or cleaning solution for use as a hard surface cleaner, the active ingredients of the builder concentrate layer will advantageously comprise an alkali metal builder salt such as sodium or potassium carbonate, an aqueous solution of an alkali metal hydroxide exemplified by a 50% solution of potassium or sodium hydroxide, and a soluble aminopolycarboxylate salt such as an alkali metal salt of ethylenediaminetetraacetic acid. In formulating a builder concentrate layer for use with a surfactant concentrate layer to produce a ready-to-use solution to serve as a degreaser, the builder layer desirably will be formulated to include a polybasic organic acid such as citric acid, or an alkali metal salt of such an acid, an aqueous solution of an alkali metal hydroxide, an aminopolycarboxylate salt, and a small amount of a stabilizer such as polyvinyl pyrrolidone. Sufficient water is added to maintain the active ingredients comprising the builder concentrate layer in solution. Generally speaking, the proportion of active materials in the builder concentrate layer will range from about 20% to about 80%, usually about 30% to about 40%, by weight, of the aqueous concentrate builder layer.

Other alkali metal builder salts which can be used in formulating the builder concentrate layer include alkali metal phosphates, sulfates, and silicates exemplified by disodium orthophosphate, sodium metaphosphate, sodium tripolyphosphate, sodium sulfate and sodium silicate, to mention a few. The corresponding ammonium salts also are useful. Exemplary of aminopolycarboxylate salts which can be used are the sodium, potassium and alkanolammonium salts formed with ethylenediaminetetraacetic acid, N-(2-hydroxyethyl)ethylenediaminetetraacetic acid and nitrilotriacetic acid. In addition to the foregoing, amine salts, alkali metal salts and ammonium salts of gluconic acid can be incorporated into the builder concentrate layer to reduce possible skin irritation.

The volume ratio of surfactant concentrate layer to builder concentrate layer of the system of the present invention can range from about 1:9 to 9:1, again depending upon the end use of the stable solution produced by the system. The total volume of the concentrated layers in the container comprising the system can vary widely, again, depending upon the final use-dilution volume required. Generally speaking, for most purposes, the total volume of the concentrate layers will be of the order of 1 to 2 ounces up to a gallon for large scale cleaning operations. The use-dilution ranges, that is, the amount or volume of diluent such as water to be used in producing a stable ready-to-use solution with the concentrates comprising a particular system also will depend upon the end use of the solution. In broad terms, the use-dilution ranges for good performance will be of the order of about 1 of the concentrate system to about 30 to about 500 of water.

The fluid-tight containers comprising the system may be fabricated of glass or plastic. For average cleaning jobs, the containers advantageously will be in the form of a flexible, single-use bag or packet made of a thermoplastic sheet material such as polyethylene. Heat sealable containers of this type will contain from about 1 or 2 to about 6 ounces of the concentrate layers, and, while resistant to tearing, can be readily opened. The concentrate layers can be injected into the bag or packet, and the bag or packet heat sealed, with conventional equipment.

The following compositions are illustrative of the system of the present invention. The percentages are given on a weight basis.

EXAMPLE I

Hard Suface Cleaner

| Surfactant Conc. Layer | | Builder Conc. Layer | |
|---|---|---|---|
| Ingredients | % | Ingredients | % |
| 1. 7–12 Mole ethoxylate of lauryl alcohol (nonionic) | 98.95 | 1. Water | 67.90 |
| 2. Herbal Pine Perfume | 1.00 | 2. Potassium Carbonate | 6.60 |
| 3. Soap Green Dye | 0.05 | 3. Tetrasodium ethylenediamine-tetraacetate ($Na_4EDTA$) | 7.20 |
| | | 4. Potash (50% KOH in water) | 18.30 |

EXAMPLE II

Hard Surface Cleaner

| Surfactant Conc. Layer | | Builder Conc. Layer | |
|---|---|---|---|
| Ingredients | % | Ingredients | % |
| 1. Linear fatty alcohol ethoxylate (Polyfac LA3) | 98.95 | 1. Water | 24.00 |
| 2. Perfume | 1.00 | 2. Potassium Carbonate | 26.00 |
| 3. Dye | 0.05 | 3. Potash solution | 18.00 |
| | | 4. $Na_4EDTA$ solution (38%) | 32.00 |

EXAMPLE III

Degreaser

| Surfactant Conc. Layer | | Builder Conc. Layer | |
|---|---|---|---|
| Ingredients | % | Ingredients | % |
| 1. 10 Mole ethoxylate of nonylphenol (nonionic) | 69.047 | 1. Water | 72.00 |
| 2. N-Tallowdimethylbenzyl ammonium chloride | 2.25 | 2. Polyvinyl Pyrrolidone | 1.00 |
| 3. N-Cetyldimethylethylbenzyl ammonium chloride | 2.25 | 3. $Na_4EDTA$ | 10.00 |
| 4. Water | 4.45 | 4. Citric Acid | 8.00 |
| 5. Betaine surfactant | 5.00 | 5. KOH (Potassium hydroxide) | 9.00 |
| 6. Silicone surfactant | 2.00 | | |
| 7. Imidazoline derivative of tall oil | 3.00 | | |
| 8. Silicone foam inhibitor | 0.003 | | |
| 9. Monoethanolamine | 12.00 | | |

EXAMPLE IV

Floor Finish Remover

| Surfactant Conc. Layer | | Builder Conc. Layer | |
|---|---|---|---|
| Ingredients | % | Ingredients | % |
| 1. Monoethanolamine | 30.47 | 1. $Na_4EDTA$ | 17.01 |
| 2. Butyl Cellosolve | 21.50 | 2. Potassium hydroxide | 10.14 |
| 3. Dodecylbenzene sulfonic acid | 6.91 | 3. Potassium Carbonate | 11.90 |
| 4. Fatty alkanolamide | 18.42 | 4. Water | 60.95 |
| 5. Nonylphenol ethoxylate (10 moles ethylene oxide) | 22.30 | | |
| 6. Silicone defoamer | 0.25 | | |
| 7. Dye | trace | | |
| 8. Fragrance | 0.15 | | |

EXAMPLE V

Bowl Cleaner

| Surfactant Conc. Layer | | Builder Conc. Layer | |
|---|---|---|---|
| Ingredients | % | Ingredients | % |
| 1. 7–12 Mole ethoxylate of octyl alcohol | 56.20 | 1. Water | 63.33 |
| 2. 7–12 Mole ethoxylate of octyl phenol | 20.69 | 2. Sodium Gluconate | 16.67 |
| 3. Isopropanol | 1.41 | 3. Potassium Carbonate | 20.00 |
| 4. Perfume | 7.14 | | |
| 5. Dye | 0.28 | | |
| 6. Cocodimethylbenzyl-ammonium chloride | 3.57 | | |
| 7. Laurylmethylethyl-benzylammonium chloride | 3.57 | | |
| 8. Water | 7.14 | | |

In order to demonstrate the improved cleaning efficiency of stable detergent or cleaning solutions or dispersions produced with the systems of the present invention over the cleaning efficiency of conventional homogeneous detergent or cleaning solutions, as well as to show the cost advantages afforded by the systems over conventional homogeneous solutions, comparative performance/cost tests were carried out using an all-purpose cleaner prepared with a system of this invention and a conventional all-purpose cleaner.

COST/PERFORMANCE COMPARISON

Table I gives the formula, cost data, and the cleaning efficiency at use-dilution for an all purpose cleaner produced from a system of the invention. At a dilution ratio of 1/256, the cleaning efficiency (C.E.) of this formulation was 80 percent and the cost of chemicals for one gallon of this use-dilution was $0.0114. Comparative data for a homogeneous formulation, using the same raw materials plus solubilizers (hydrotropes or solvents), are given in Table II. The homogeneous formulation required a 1/20 dilution to yield a C.E. of 77.5% at a cost of $0.0602/use-dilution gallon. Thus, a homogeneous preparation had to be 12.8 times more concentrated at use-dilution to yield similar cleaning, and this costs approximately six-times more than the system of this invention.

TABLE I

All Purpose Cleaner

| | % | $ cost | $ cost/100 lbs. |
|---|---|---|---|
| Builder Concentrate | | | |
| Water | 21.40 | 0.0001 | 0.0021 |
| Potassium Carbonate | 9.00 | 0.315 | 2.835 |
| Potassium Citrate | 9.00 | 0.840 | 7.560 |
| Caustic Potash | 10.60 | 0.1645 | 1.7437 |
| Surfactant Concentrate | | | |
| Nonyl Phenol ethylene oxide | 35.00 | 0.4525 | 15.8375 |
| Diethylene glycol monomethyl ether | 14.45 | 0.4200 | 6.069 |
| Perfume | 0.50 | 4.0000 | 2.0000 |
| Dye | 0.05 | 9.7080 | 0.4854 |
| | 100.00 | | $36.5327 |

Cost per pound = 0.3653 (0.0625 lb./oz.) = $0.228/oz.
At a 1/256 use dilution the cleaning efficiency = 80.0%
To make one gallon use dilution uses $\frac{.5 \text{ oz. concentrate}}{128 \text{ oz. water}}$
Cost per gallon of use dilution product is $0.0114
Equal parts (1 oz. each) of layers A and B are contained in one packet.
This total 2-ounce product is diluted with 4 gallons water to yield a 1/256 use dilution.

TABLE II

Homogeneous Conventional All Purpose Cleaner

| | Cost/Performance Data | | |
|---|---|---|---|
| | % | $ cost | $ cost/ 100 lbs. |
| Water | 60.0471 | 0.0001 | 0.0060 |
| Potassium Carbonate | 2.1982 | 0.315 | 0.6924 |
| Potassium Citrate | 2.1982 | 0.84 | 1.8465 |
| Nonyl phenol ethylene oxide | 9.4483 | 0.5225 | 4.9367 |
| Diethylene glycol monomethyl ether | 3.9008 | 0.4900 | 1.9114 |
| Isopropyl alcohol | 5.5704 | 0.3089 | 1.7207 |
| Propylene glycol | 5.0348 | 0.3950 | 1.9888 |
| Sodium Xylene Sulfonate | 3.2137 | 0.2679 | 0.8610 |
| Caustic Potash | 2.5890 | 0.1895 | 0.4906 |
| Perfume | 0.135 | 4.000 | 0.54 |
| Dye | 0.0135 | 9.7080 | 0.1311 |
| | | | $15.1252 |

Cost per pound = 0.1512 (0.0625 lb./oz.) = $0.0094/oz.
At a 1/20 use dilution cleaning efficiency = 77.5%
To make one gallon use dilution uses $\frac{6.4 \text{ oz. concentrate}}{128 \text{ oz. water}}$
Cost per gallon of use dilution product is $0.0602

EXPERIMENTAL PROCEDURE

The cleaning efficiencies reported in the preceding tables were derived using a standard washability test. This test methodology is a modified form of Federal Test Method Standard No. 536/670. The methodology used is given below:

METHOD OF WASHABILITY

I. Panel Preparation

1. Read reflectance of white tile * with Photovolt Meter (Rf=67.5)
2. Soil panels with standard soil (from federal test standard method) using a 5 mil. film applicator.
3. Allow panels to age overnite (use within 1 week at most).

*Armstrong "EXCELON" standard tile.

II. Washing of Panels

1. Make up 200 ml of use dilution cleaning solution for each tile (run 2 tiles per solution).
2. Apply 50 ml to sponge in sponge holder. Pour remaining 150 ml. to sponge in sponge holder. Pour remaining 150 ml over panel which is clamped into the tray of the Gardner washability apparatus.
3. Soak panel in solution for 60 seconds.
4. Run sponge over panel for 50 cycles (100 strokes).
5. Remove panel and rinse off residue with tap water.
6. Dry for at least 30 minutes.

III. Calculation of Cleaning Efficiency (C.E.)

1. Set Photovolt Meter to 75% Rf with the green filter inserted.
2. Read reflectance of panel at 3, 6, and 9 inches from top of panel. Calculate average of these 3 numbers=Rf soiled.
3. Calculate C.E. by using equation Rf soiled/67.5×100=C.E. %

What is claimed is:

1. A detergent system for single-use applications in providing a substantially homogeneous aqueous solution or dispersion of predetermined composition to be used for detergent, cleaning, or the like, purposes, comprising a fluid-tight container having at least two separate layers of liquid compositions therein, one of said layers comprising, as an essential ingredient, a predetermined proportion of a concentrate of at least one surfactant which is soluble or readily dispersible in water; and another of said layers comprising, as an essential ingredient, an aqueous solution, in the form of a concentrate, which includes a predetermined proportion of at least one detergent builder; the compositions of said separate layers being of a character such that, if mixed together in their concentrated form, they would be incompatible or immiscible and the resulting mixed composition would be non-homogeneous; said liquid compositions of said separate layers being so related as to the ingredients and proportions thereof that, when essentially all of the liquid contents of the layers in said container are poured into a predetermined proportion of water, a final essentially stable solution or dispersion is obtained in ready-to-use form for the intended detergent, cleaning, or the like, use of the thus finally produced stable solution.

2. A system according to claim 1 wherein the surfactant concentrate is a nonionic, anionic, cationic or amphoteric surfactant, or a compatible mixture thereof.

3. A system according to claim 2 wherein the nonionic, anionic, cationic or amphoteric surfactant, or compatible mixture thereof comprises from about 50% to about 99% of the surfactant concentrate.

4. A system according to claim 1 wherein the detergent builder concentrate includes at least one alkali metal or ammonium carbonate, phosphate, sulfate or silicate, the proportion thereof in the concentrate being in the range of about 30% to about 80%, by weight, of the concentrate.

5. A system according to claim 1 wherein the fluid-tight container comprises a flexible packet formed of a heat-sealable plastic sheet material.

6. A system according to claim 1 wherein the use-dilution range of the total concentrate system in the container is from about 1 of the concentrate system to about 500 of the diluent used to form the final ready-to-use solution or dispersion.

7. A system according to claim 1 wherein the surfactant concentrate layer comprises about 99%, by weight, of a water soluble condensate of an alkylphenol with from about 5 to 15 moles of ethylene oxide, and the builder concentrate layer comprises about 30%, by weight, of a mixture of an alkali metal carbonate, an alkali metal hydroxide and an alkali metal salt of ethylenediaminetetraacetic acid.

8. A system according to claim 1 wherein the surfactant concentrate layer comprises a major proportion of a mixture of a nonionic surfactant and a cationic surfactant, the nonionic surfactant comprising a water soluble condensate of an alkylphenol with from about 7–12 moles of ethylene oxide, and the cationic surfactant comprising a water soluble quaternary ammonium salt.

9. A system according to claim 1 wherein the builder concentrate layer comprises a minor proportion of a polybasic organic acid or an alkali metal salt thereof.

10. A system according to claim 1 wherein the surfactant concentrate layer contains essentially no water.

11. A system according to claim 1 wherein the surfactant concentrate layer comprises less than about 10%, by weight, of water.

12. In a method of preparing a substantially homogeneous aqueous solution or dispersion of predetermined composition useful for detergent or cleansing purposes which comprises providing a fluid-tight container having at least two separate layers of liquid compositions therein, one of said layers comprising, as an essential ingredient, a predetermined proportion of at least one water-soluble surfactant as a concentrate thereof in the form of a liquid product which is soluble or readily dispersible in water, and the other of said layers comprising, as an essential ingredient, a water solution, in the form of a concentrate, which includes a predetermined proportion of at least one inorganic builder; the compositions of said separate layers being of a character such that, if mixed together in their concentrated form, they would be incompatible or immiscible and the resulting mixed composition would be nonhomogeneous; providing a predetermined proportion of water in a suitable second container; and then pouring into said water essentially all of the liquid contents of the layers in said fluid-tight container to produce a final, dilute essentially homogeneous stable solution or dispersion in ready-to-use form for intended detergent or cleaning use of said thus finally produced aqueous composition.

13. A method according to claim 12 wherein the container comprises a fluid-tight packet formed of a flexible, heat-sealable plastic sheet material.

14. A method according to claim 12 wherein the use-dilution range of the total concentrate system in the container is from about 1 of the concentrate system to about 500 of the diluent used to form the final ready-to-use solution or dispersion.

15. A method according to claim 12 wherein the volume of the total concentrate system in the container is from about 1 ounce to about 1 gallon.

* * * * *